US006446322B1

(12) United States Patent
Church

(10) Patent No.: US 6,446,322 B1
(45) Date of Patent: Sep. 10, 2002

(54) METHOD AND APPARATUS FOR SEALING CANISTERS

(75) Inventor: Russell Edward Church, Jackson, MI (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 0 days.

(21) Appl. No.: 09/568,632

(22) Filed: May 10, 2000

(51) Int. Cl.[7] ..... B23P 11/00

(52) U.S. Cl. ..... 29/513; 29/890.08

(58) Field of Search ..... 29/890.08, 890.053, 29/513, 509, 243.58, 243.517, 243.5; 72/51; 413/6, 27, 31

(56) References Cited

U.S. PATENT DOCUMENTS

| | | | | |
|---|---|---|---|---|
| 3,030,900 A | * | 4/1962 | Munschauer et al. | 413/31 |
| 3,425,381 A | * | 2/1969 | Wessely | 413/6 |
| 4,055,133 A | * | 10/1977 | Wessely | 413/6 |
| 4,513,596 A | | 4/1985 | Usher | |
| 4,567,742 A | | 2/1986 | Castricum | |
| 4,864,712 A | | 9/1989 | Carden et al. | |
| 4,924,684 A | | 5/1990 | Castricum | |
| 5,049,424 A | | 9/1991 | Carden et al. | |
| 5,054,265 A | * | 10/1991 | Perigo et al. | 413/6 |
| 5,105,639 A | | 4/1992 | Castricum | |
| 5,143,504 A | * | 9/1992 | Braakman | 413/6 |
| 5,193,374 A | | 3/1993 | Castricum | |
| 5,257,521 A | | 11/1993 | Castricum | |
| 5,692,300 A | | 12/1997 | Conn et al. | |
| 5,860,305 A | | 1/1999 | Castricum | |
| 5,943,891 A | | 8/1999 | Takagi et al. | |
| 5,980,744 A | | 11/1999 | Gagnon et al. | |

* cited by examiner

*Primary Examiner*—I Cuda-Rosenbaum
*Assistant Examiner*—T. Nguyen
(74) *Attorney, Agent, or Firm*—Harness, Dickey & Pierce, P.L.C.

(57) ABSTRACT

A method and apparatus is described for forming a lock seam for joining a first edge of material to a second edge of material. The lock seam is characterized by the first edge being wrapped in a first curl such that the first curl is substantially circular in shape. The second edge is wrapped in a second curl which is also substantially circular in shape. The inside surface of the first curl is wrapped about the outer surface of the second curl. The lock seam formed by this manner is particularly advantageous for muffler assembly.

10 Claims, 7 Drawing Sheets

METHOD AND APPARATUS FOR SEALING CANISTERS

FIELD OF THE INVENTION

The present invention relates generally to the joining of the ends or edges of one or more pieces of material, and more particularly to a method and apparatus for joining the ends of a muffler shell to produce a sound mechanical joint having an aesthetically pleasing appearance.

BACKGROUND OF THE INVENTION

Various methods have been employed to join two pieces of material together in current manufacturing and assembly technologies. For instance, welding and mechanical joining are typically employed for joining pieces of sheet metal together, especially the ends or edges thereof.

In conventional muffler assembly, a piece of sheet metal is typically wrapped around a muffler assembly, thereby encapsulating and supporting the internal components. The sheet metal is welded or mechanically joined together at its respective ends to form a seam.

While welding structurally provides a sound method of joining the respective ends of the sheet metal together, this method fails to provide an aesthetically pleasing appearance for the resulting muffler. As such, manufacturers are typically required to provide a second housing (e.g., a cover or wrap) over the sheet metal cover to hide the unsightly weld marks on the sheet metal.

Therefore, there existed a need in the relevant art to provide a method of joining two ends of sheet metal in such a way as to provide a sound structural joint which is also aesthetically pleasing. Examples of joining techniques can be found in U.S. Pat. Nos. 4,513,596; 4,567,742; 4,864,712; 4,924,684; 5,049,424; 5,105,639; 5,193,374; 5,247,521; 5,692,300; 5,860,305; 5,943,891; and 5,980,744, the entire specifications of which are incorporated herein by reference.

One method used to join respective ends of sheet metal involved the use of a lock seam. The lock seam method employs forming the respective ends into an interlocking set of folds which cooperate to maintain the two respective ends joined. While this method does provide an aesthetically pleasing and structurally sound joint, its creation requires force to be applied on the joint in a direction toward the muffler body. However, the internal components of the muffler provide little or no support to most of the cover area of the sheet metal. As such, application of this type of joint causes deformation and damage to the cover of the muffler.

A further concern with respect to lock seams is their structural integrity. Commonly, these seams incorporate a series of flat folds which provides room for lateral movement of the respective ends in the seam, thereby weakening the joint.

In view of the above, it would be desirable to provide a method and apparatus for manufacturing a lock seam that is mechanically sound and also aesthetically pleasing, but does not require force to be applied in a direction toward the body of the muffler when it is formed.

SUMMARY OF THE INVENTION

In view of the above, it is an object of the present invention to provide a method for forming a lock seam which does not require force to be exerted in a direction toward the body to be sealed.

It is a further object of the present invention to provide an apparatus for forming a lock seam which provides a structurally sound joint that is also aesthetically pleasing to view.

In accordance with the broad teachings of this invention, a method and apparatus for manufacturing a lock seam having an advantageous construction is provided. The lock seam for joining a first edge of material to a second edge of material has the first edge wrapped in a first curl such that the first curl is substantially circular in shape. The second edge is wrapped in a second curl which is also substantially circular in shape. The inside surface of the first curl is wrapped about said outer surface of said second curl.

In a further aspect of the present invention, a pressureless lock seam is utilized in conjunction with a muffler. By the term "pressureless" as that term is used herein, it is meant that the lock seam is formed without the application of any substantial amount of pressure directly toward the body to be sealed (i.e., perpendicular to the body). The lock seam of the present invention is formed by the application of forces that are substantially parallel to the body to be sealed. The muffler has a muffler canister, an inlet head/bushing and an outlet head/bushing positioned on opposite sides of the canister. An outer wrap is provided which encapsulates the canister. The outer wrap is positioned flush against and extending around the periphery of the inlet head/bushing and the periphery of the outlet head/bushing. The outer wrap is then joined by a lock seam produced in accordance with the general teachings of the present invention.

In accordance with one embodiment of the present invention, a method for forming a seam is provided, comprising:

- providing a sheet having spaced and opposed first and second edges;
- providing an object to be encapsulated by the sheet;
- positioning the object on the sheet parallel to the first and second edges;
- manipulating the first and second edges towards one another so that the surfaces of the first and second edges contact one another in a substantially flush manner so as to form a flange-like projection, wherein one edge extends past the other edge;
- manipulating the flange-like projection so as to form the seam, wherein the seam comprises the first edge wrapped in a first curl and the second edge wrapped in a second curl, the first curl being substantially circular in shape and the second curl being substantially circular in shape, wherein an inside surface of the first curl is wrapped about an outer surface of the second curl.

In accordance with another embodiment of the present invention, a method for forming a seam for a muffler is provided, comprising:

- providing an outer wrap having spaced and opposed first and second edges;
- providing a muffler canister to be encapsulated by the outer wrap;
- positioning the muffler canister on the outer wrap parallel to the first and second edges;
- manipulating the first and second edges towards one another so that the surfaces of the first and second edges contact one another in a substantially flush manner so as to form a flange-like projection, wherein one edge extends past the other edge;
- manipulating the flange-like projection so as to form the seam, wherein the seam comprises the first edge wrapped in a first curl and the second edge wrapped in a second curl, the first curl being substantially circular in shape and the second curl being substantially circular in shape, wherein an inside surface of the first curl is wrapped about an outer surface of the second curl.

In accordance with still another embodiment of the present invention, an apparatus for forming a seam from spaced and opposed first and second edges of a sheet for encapsulating an object is provided, comprising:

a selectively operable system for manipulating the first and second edges towards one another so that the surfaces of the first and second edges contact one another in a substantially flush manner so as to form a flange-like projection, wherein one edge extends past the other edge; and at least one other selectively operable system for manipulating the flange-like projection so as to form the seam, wherein the seam comprises the first edge wrapped in a first curl and the second edge wrapped in a second curl, the first curl being substantially circular in shape and the second curl being substantially circular in shape, wherein an inside surface of the first curl is wrapped about an outer surface of the second curl.

In accordance with still another embodiment of the present invention, an apparatus for forming a seam from spaced and opposed first and second edges of an outer wrap for encapsulating a muffler canister is provided, comprising:

a selectively operable system for manipulating the first and second edges towards one another so that the surfaces of the first and second edges contact one another in a substantially flush manner so as to form a flange-like projection, wherein one edge extends past the other edge; and at least one other selectively operable system for manipulating the flange-like projection so as to form the seam, wherein the seam comprises the first edge wrapped in a first curl and the second edge wrapped in a second curl, the first curl being substantially circular in shape and the second curl being substantially circular in shape, wherein an inside surface of the first curl is wrapped about an outer surface of the second curl.

Further areas of applicability of the present invention will become apparent from the detailed description provided hereinafter. It should be understood that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

The same reference numerals refer to the same parts throughout the various Figures.

DETAILED DESCRIPTION OF THE PREFERRED EMBODIMENTS

The following description of the preferred embodiment(s) is merely exemplary in nature and is in no way intended to limit the invention, its application, or uses.

Figure 1:
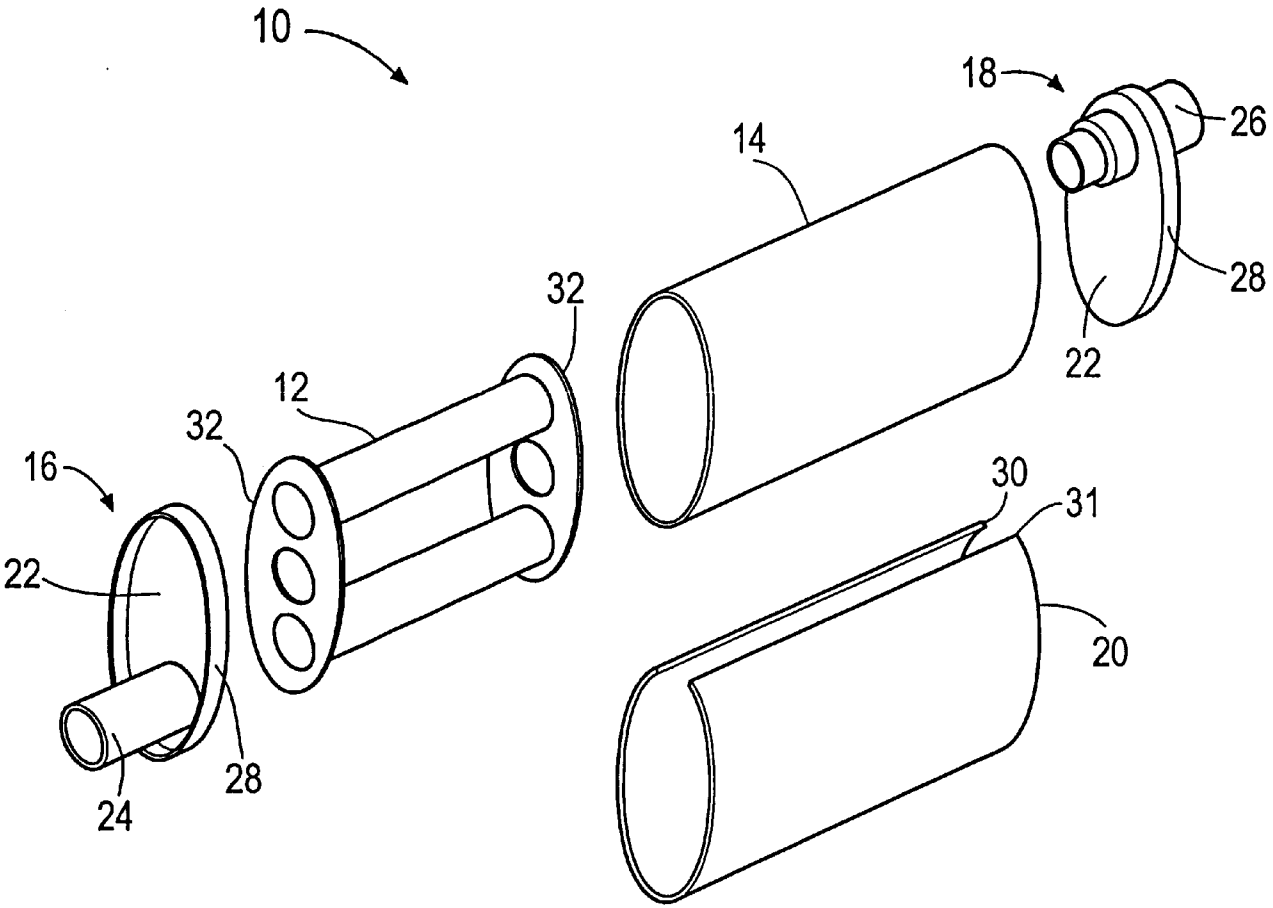
FIG. - 1 (PRIOR ART)
FIG. 1 is an exploded view of a muffler, according to the prior art.

Referring now to FIG. 1, an exploded view of a muffler 10 according to the prior art is shown generally having a muffler canister 12 (typically including one or more tubes having one or more canister plates 32 attached thereto), muffler shell 14, inlet head/bushing 16, outlet head/bushing 18, and outer wrap 20. Inlet head/bushing 16 and outlet head/bushing 18 each have a face portion 22 which supports respective inlet busing 24 and outlet bushing 26. Inlet head/bushing 16 and outlet head/bushing 18 include respective flange portions 28 which extend from face portions 22 in a direction away from muffler shell 14.

When assembled, muffler canister 12 is first slid into muffler shell 14 and may be then welded thereto. Outer wrap 20 is then wrapped about muffler shell 14 where a mechanical lock seam is formed along edges 30 and 31 to mechanically affix outer wrap 20 about muffler shell 14. Inlet head/bushing 16 and outlet head/bushing 18 are then slid into muffler shell 14 on either side of muffler canister 12 and then mechanically attached thereto.

Figure 3:
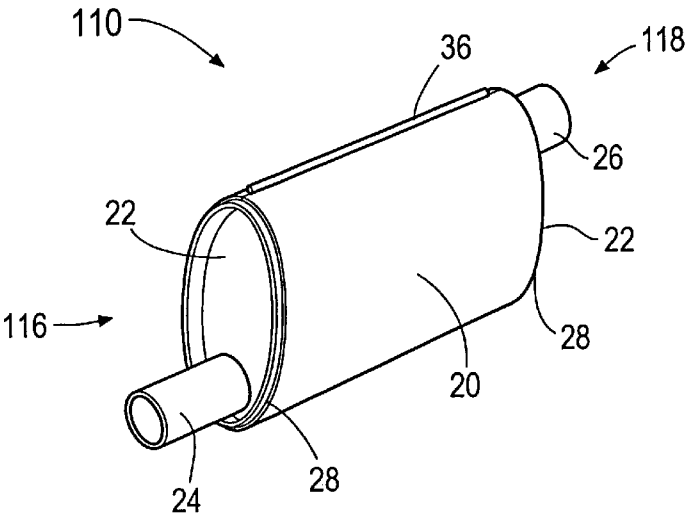
FIG. 3 is a perspective view of an assembled muffler, according to the present invention.
Figure 2:
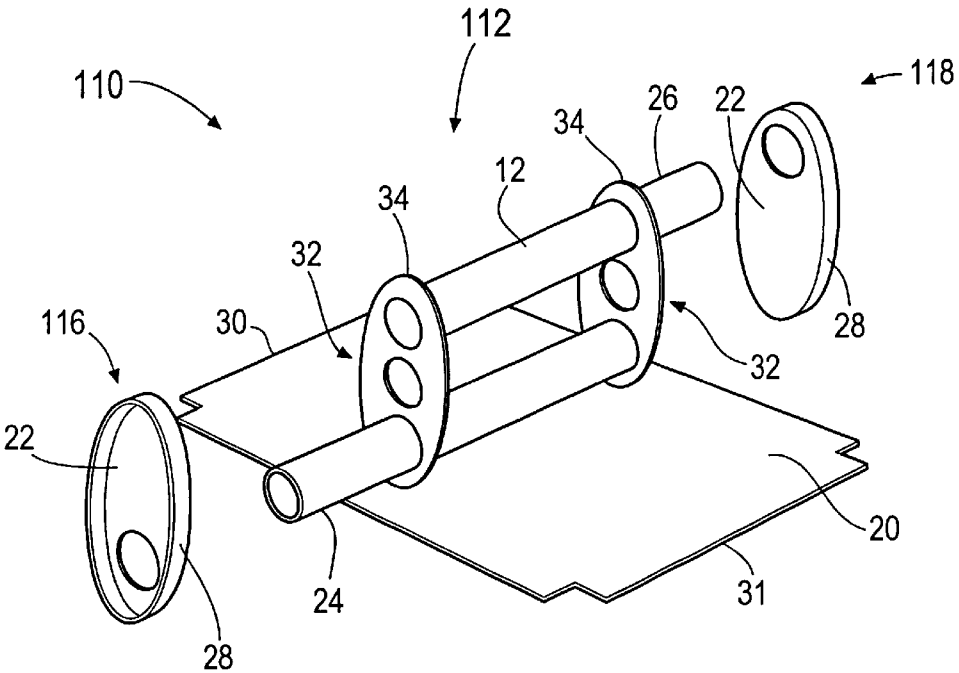
FIG. 2 is an exploded view of an unassembled muffler, according to the present invention.

Referring now to FIGS. 2 and 3, one embodiment of the present invention is shown and described. FIG. 2 illustrates a muffler canister assembly 112, consisting of muffler canister 12 and attached inlet bushing 24 and outlet bushing 26, positioned on a sheet of outer wrap 20 with inlet head 116 and outlet head 118 shown exploded outwardly therefrom. It should be appreciated that the inlet bushing 24 and outlet bushing 26 do not have to be previously attached to the muffler 12 in order to practice the present invention. The muffler canister assembly 112 illustrates that sub-assemblies can be used to speed up the manufacturing process and reduce overall part cost and content. Outer wrap 20 is wrapped about the periphery 34 of each canister plate 32. Then, edges 30 and 31 are joined together by a mechanical lock seam according to the present invention. By way of a non-limiting example, edges 30 and 31 are placed in abutting relationship, wherein one edge extends slightly past or above the other edge. The abutting edges are then manipulated in such a manner so as to produce the lock seam shown of the present invention. This manipulation is accomplished preferably by manipulating, without applying pressure radially inwardly toward the axis of the muffler, the projecting edge so as to form the seam. The seam then comprises the first edge wrapped in a first curl and the second edge wrapped in a second curl. An inside surface of the first curl is wrapped about an outer surface of the second curl. By way of a non-limiting example, this can be accomplished by the selective application of one or more forces (e.g., bending or pushing forces) to the abutting edges, wherein the force is substantially perpendicular to the abutting edges, or expressed differently, substantially parallel to the body to be sealed (e.g., muffler canister 12). Inlet head 116 and outlet head 118 are then slid into muffler shell 20 and mechanically attached to shell 20. Inlet bushing 24 and outlet bushing 26 are mechanically locked to inlet head 116 and outlet head 118, respectively.

FIG. 3 shows the resulting constructed or assembled muffler 110. It should be noted that lock seam 36 joins edges 30 and 31 of outer wrap 20.

Figure 4:
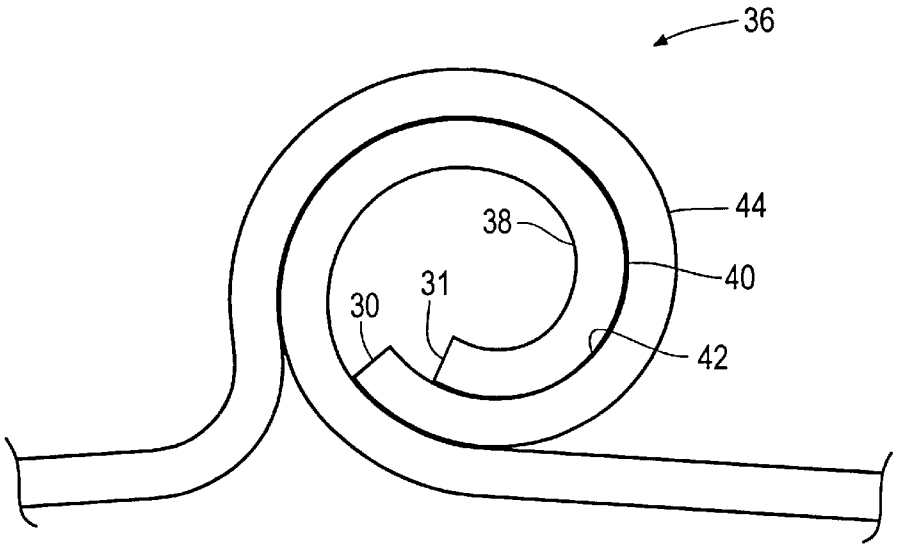
FIG. 4 is a cross-sectional view of a lock seam, according to the present invention.

Referring now to FIG. 4, end 31 is shown having outer surface 38 and inner surface 40. Likewise, end 30 is shown having inner surface 42 and outer surface 44. Ends 30 and 31 are wrapped in a circular fashion such that inner surface 40 communicates with inner surface 42 to lockingly engage edge 31 with edge 30. The circular shape of edge 31 and edge 30 ensures that a maximum number of points between inner surface 40 and inner surface 42 maintain edges 31 and 30 from moving back and forth in a lateral direction.

Figure 5:
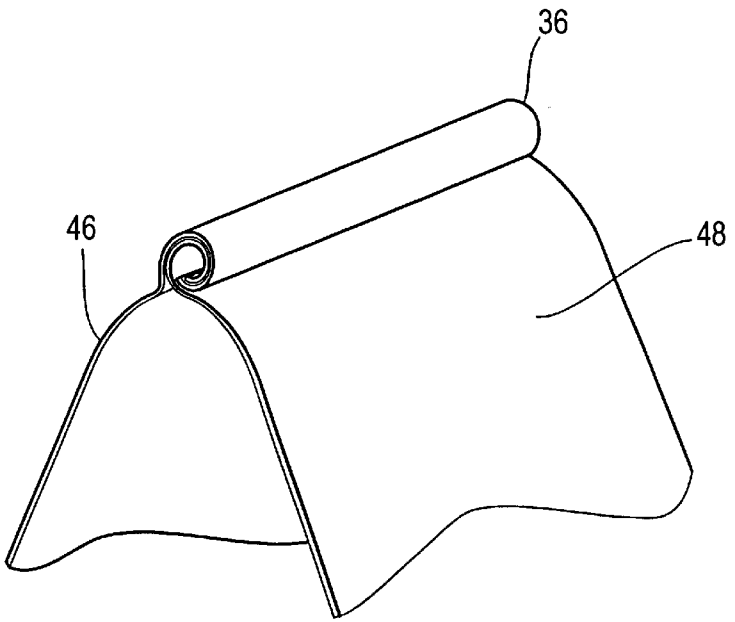
FIG. 5 is a partial perspective view of a lock seam, according to the present invention.

Referring now to FIG. 5, lock seam 36 is shown joining two separate sheets 46 and 48, thereby maintaining these elements in a locked relationship.

In order to form the lock seam of the present invention, it is necessary to precisely manipulate edges 31 and 30 in order to form the characteristic circular configuration. The apparatus to form the lock seam of the present invention can include any type of device that can gather edges 31 and 30 together into a precise predetermined configuration and then manipulate that configuration through a series of forming steps in order to form the lock seam of the present invention. For example, presses (e.g., selectively operable chucks) and rolls (e.g., selectively operable rotating rolls) that come into operable engagement can form and shape edges 31 and 30 into the lock seam of the present invention.

In order to fully appreciate the method and apparatus of the present invention, it is helpful to discuss, for comparison purposes, a typical method and apparatus for forming conventional lock seams.

Figure 6:
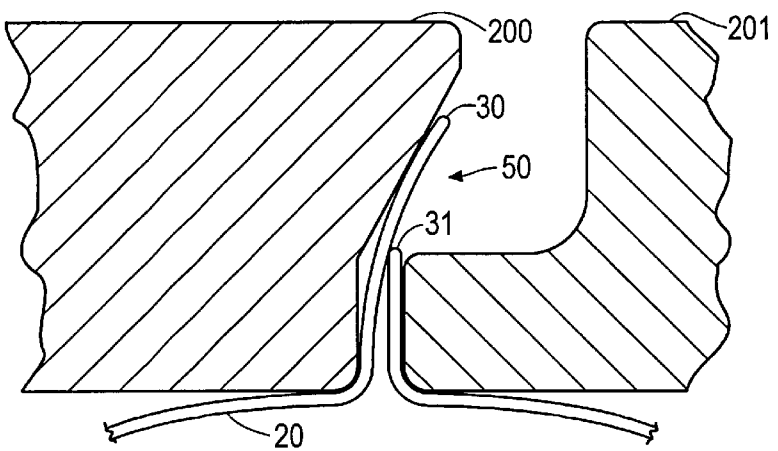
FIG. - 6 (PRIOR ART)
FIG. 6 is a partial cross-sectional view of an illustrative apparatus for forming a conventional lock seam, according to the prior art, wherein the first major formation step is shown.

Referring to FIG. 6, there is shown a partial cross-sectional view of an illustrative apparatus for forming a conventional lock seam, according to the prior art. In this view, the first major formation step is shown, i.e., edges 31 and 30 of outer wrap 20 are brought into relatively close contact (i.e., gathered) to form a flange-like projection 50. This gathering step is typically accomplished by one or more sets of rolls 200, 201 (e.g., one or more of which would be moved perpendicularly with respect to flange-like projection 50). It should be noted that one edge, in this case edge 30, extends past the other edge, in this case edge 31. It should also be noted that an arbor (not shown) would typically be positioned underneath the outer wrap to provide the requisite physical support during the lock seam formation process.

Figure 7:
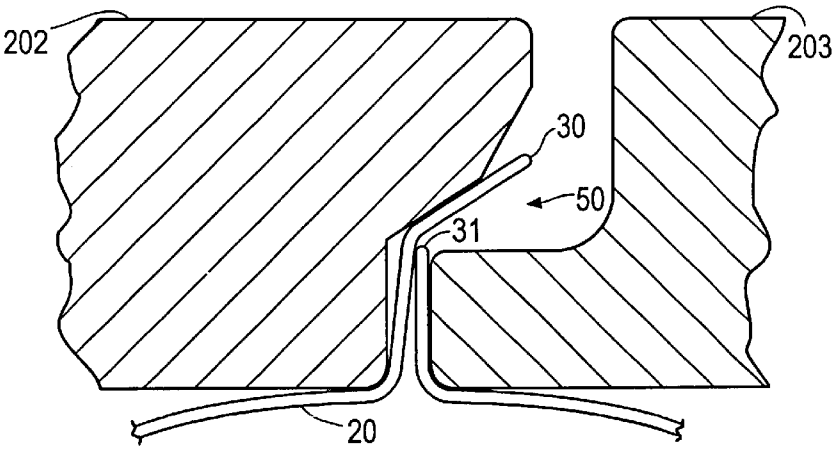
FIG. - 7 (PRIOR ART)
FIG. 7 is a partial cross-sectional view of an illustrative apparatus for forming a conventional lock seam, according to the prior art, wherein the second major formation step is shown.

Referring to FIG. 7, there is shown a partial cross-sectional view of the illustrative apparatus during the second major formation step for forming a conventional lock seam, according to the prior art. In this view, edge 30 is contacted by roll 202 which presses toward the direction of roll 203. In this manner, flange-like projection 50 is pushed downwardly, while edge 31 remains in its original position as shown in FIG. 6.

Figure 8:
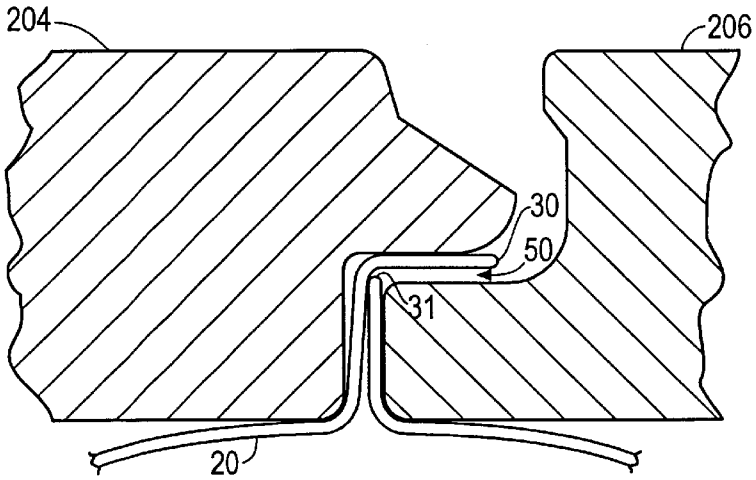
FIG. - 8 (PRIOR ART)
FIG. 8 is a partial cross-sectional view of an illustrative apparatus for forming a conventional lock seam, according to the prior art, wherein the third major formation step is shown.

Referring to FIG. 8, there is shown a partial cross-sectional view of the illustrative apparatus during the third major formation step for forming a conventional lock seam, according to the prior art. In this view, edge 30 is further contacted by roll 204 which presses toward the direction of roll 206. In this manner, flange-like projection 50 is pushed downwardly even further, while edge 31 remains in its original position as shown in FIG. 6.

Figure 9:
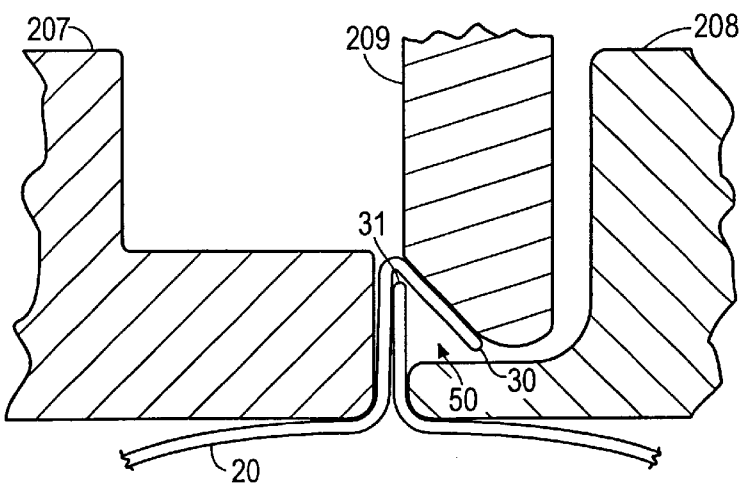
FIG. - 9 (PRIOR ART)
FIG. 9 is a partial cross-sectional view of an illustrative apparatus for forming a conventional lock seam, according to the prior art, wherein the fourth major formation step is shown.

Referring to FIG. 9, there is shown a partial cross-sectional view of the illustrative apparatus during the fourth major formation step for forming a conventional lock seam, according to the prior art. In this view, neither roll 207 or 208 further contact edge 30. Rather, it is roll 209 which contacts edge 30 (in a perpendicular direction relative to edge 30), thus pressing edge 30 toward the object to be encapsulated (e.g., the muffler canister). Both roll 207 and 208 rotate. In this manner, flange-like projection 50 is pushed downwardly still even further, while edge 31 remains in its original position as shown in FIG. 6.

Figure 10:
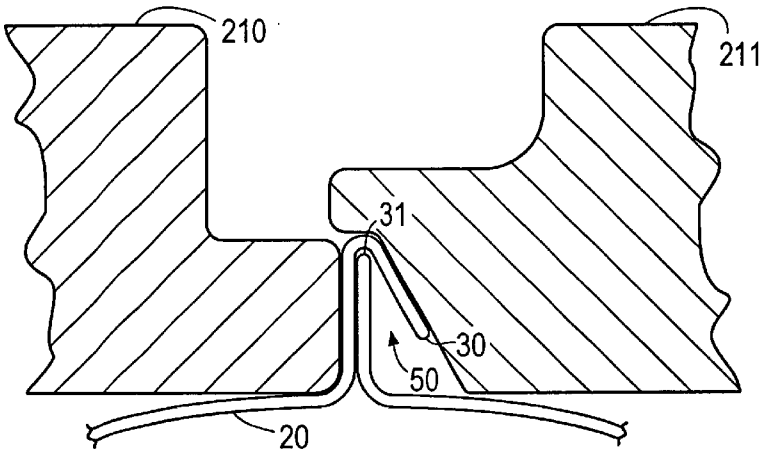
FIG. - 10 (PRIOR ART)
FIG. 10 is a partial cross-sectional view of an illustrative apparatus for forming a conventional lock seam, according to the prior art, wherein the fifth major formation step is shown.

Referring to FIG. 10, there is shown a partial cross-sectional view of the illustrative apparatus during the fifth major formation step for forming a conventional lock seam, according to the prior art. In this view, edge 30 is further contacted by roll 211 which presses toward the direction of roll 210. In this manner, flange-like projection 50 is pushed downwardly yet even further (so as to be flush against edge 31), while edge 31 remains in its original position as shown in FIG. 6.

Figure 11:
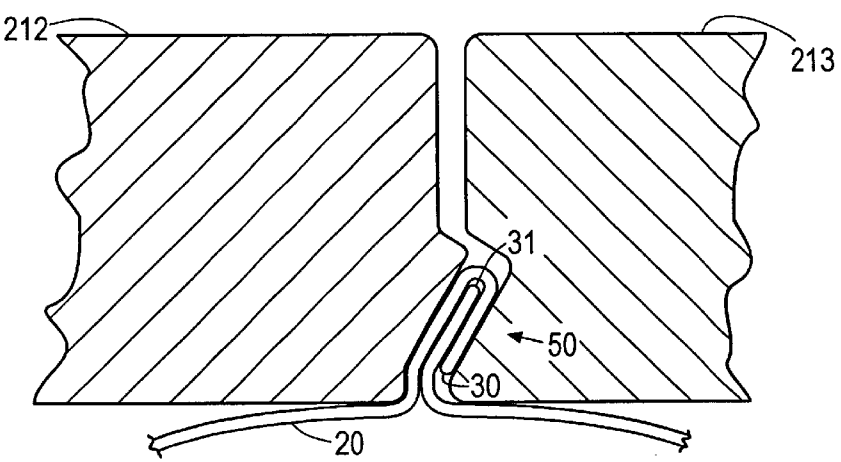
FIG. - 11 (PRIOR ART)
FIG. 11 is a partial cross-sectional view of an illustrative apparatus for forming a conventional lock seam, according to the prior art, wherein the sixth major formation step is shown.

Referring to FIG. 11, there is shown a partial cross-sectional view of the illustrative apparatus during the sixth major formation step for forming a conventional lock seam, according to the prior art. In this view, flange-like projection 50 is contacted by roll 212 which presses toward the direction of roll 213. In this manner, flange-like projection 50 is pushed downwardly.

Figure 12:
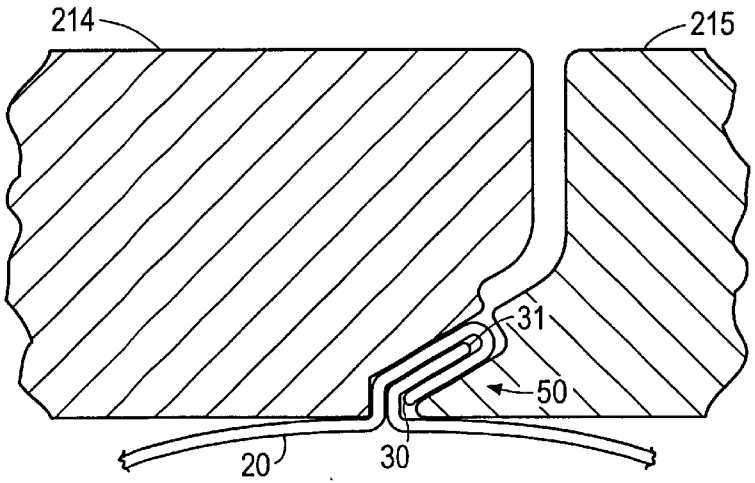
FIG. - 12 (PRIOR ART)
FIG. 12 is a partial cross-sectional view of an illustrative apparatus for forming a conventional lock seam, according to the prior art, wherein the seventh major formation step is shown.

Referring to FIG. 12, there is shown a partial cross-sectional view of the illustrative apparatus during the seventh major formation step for forming a conventional lock seam, according to the prior art. In this view, flange-like projection 50 is further contacted by roll 214 which presses toward the direction of roll 215. In this manner, flange-like projection 50 is pushed further downwardly.

Figure 13:
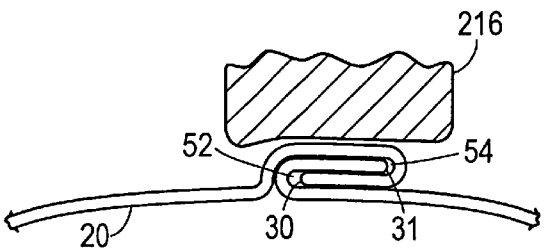
FIG. - 13 (PRIOR ART)
FIG. 13 is a partial cross-sectional view of an illustrative apparatus for forming a conventional lock seam, according to the prior art, wherein the eighth major formation step is shown.

Referring to FIG. 13, there is shown a partial cross-sectional view of the illustrative apparatus during the eighth and final major formation step for forming a conventional lock seam, according to the prior art. In this view, flange-like projection 50 is contacted by roll 216 (in a perpendicular direction relative to flange-like projection 50) which presses toward the object to be encapsulated (e.g., the muffler canister). In this manner, flange-like projection 50 is pushed further downwardly to form the conventional lock seam. It should be noted that gaps 52 and 54 result as a consequence of the conventional lock seam formation process. Additionally, the application of forces perpendicular or at least substantially perpendicular to the object to be encapsulated typically results in damage to either the seam, the outer wrap, and/or the object to be encapsulated (e.g., the muffler canister).

Conversely, the present invention avoids the problems typically associated with conventional methods and apparatuses for forming conventional lock seams.

Figure 14:
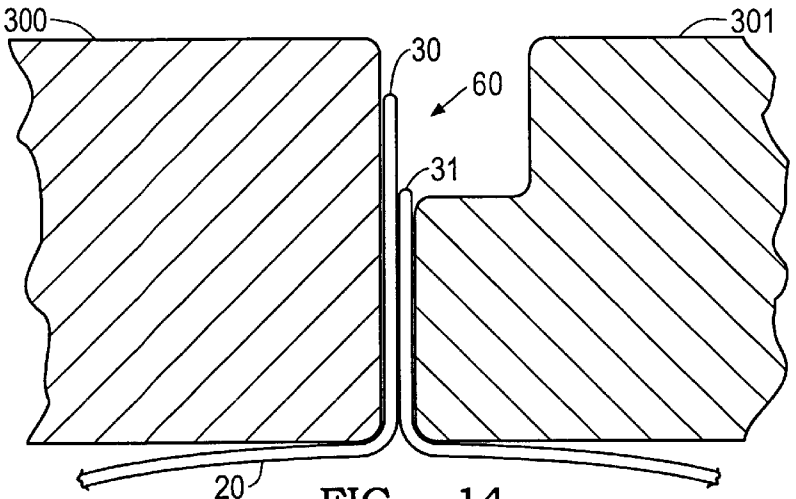
FIG. 14 is a partial cross-sectional view of an illustrative apparatus for forming a lock seam, according to the general teachings of the present invention, wherein the first major formation step is shown.

Referring to FIG. 14, there is shown a partial cross-sectional view of an illustrative apparatus for forming a lock seam, according to the general teachings of the present invention. In this view, the first major formation step is shown, i.e., edges 31 and 30 of outer wrap 20 are brought into extremely close contact (i.e., gathered) to form a flange-like projection 60. Preferably, edges 31 and 30 are at least substantially flush against one another and form an approximate 90° angle with the surface of outer wrap 20. Again, this gathering step is typically accomplished by one or more sets of rolls 300, 301 (e.g., one or more of which would be moved perpendicularly with respect to flange-like projection 60). It should be noted that one edge, in this case edge 30, extends past the other edge, in this case edge 31. It should also be noted that an arbor is not required to be positioned underneath the outer wrap to provide the requisite physical support during the lock seam formation process, due to the fact that the present invention does not apply forces perpendicular or at least substantially perpendicular to the object to be encapsulated (e.g., the muffler canister).

Figure 15:
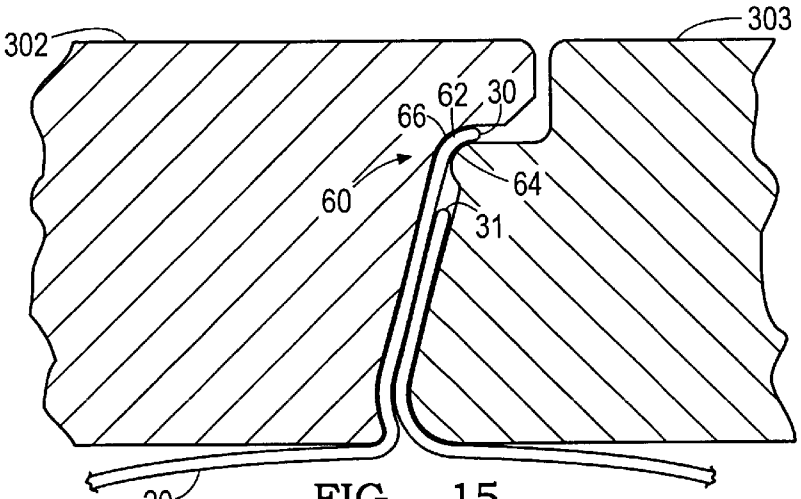
FIG. 15 is a partial cross-sectional view of an illustrative apparatus for forming a lock seam, according to the general teachings of the present invention, wherein the second major formation step is shown.

Referring to FIG. 15, there is shown a partial cross-sectional view of the illustrative apparatus during the second major formation step for forming a lock seam, according to the general teachings of the present invention. In this view, edge 30 is contacted by roll 302 which presses toward the direction of roll 303 which remains stationary. In this manner, both edges 30 and 31 of flange-like projection 60 are pushed downwardly, with curl 62 being formed as a result of being compressed between boss 64 on roll 303 and depression 66 on roll 302.

Figure 16:
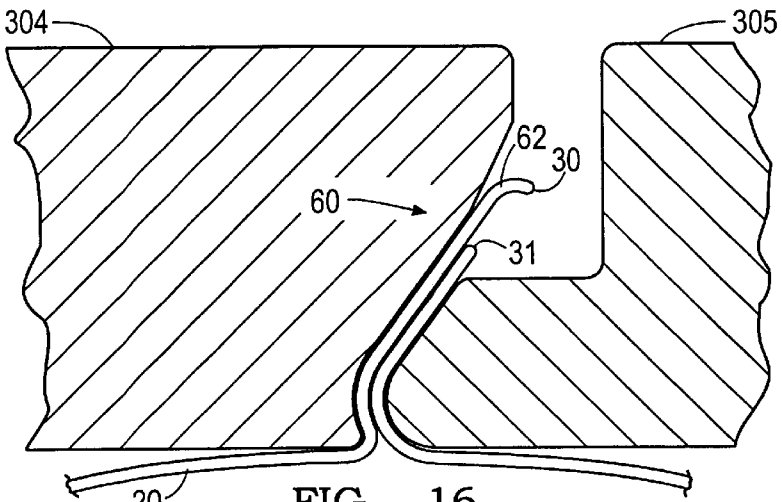
FIG. 16 is a partial cross-sectional view of an illustrative apparatus for forming a lock seam, according to the general teachings of the present invention, wherein the third major formation step is shown.

Referring to FIG. 16, there is shown a partial cross-sectional view of the illustrative apparatus during the third major formation step for forming a lock seam, according to the general teachings of the present invention. In this view, edge 30 is further contacted by roll 304 which presses toward the direction of roll 305. In this manner, both edges 30 and 31 of flange-like projection 60 are pushed further downwardly.

Figure 17:
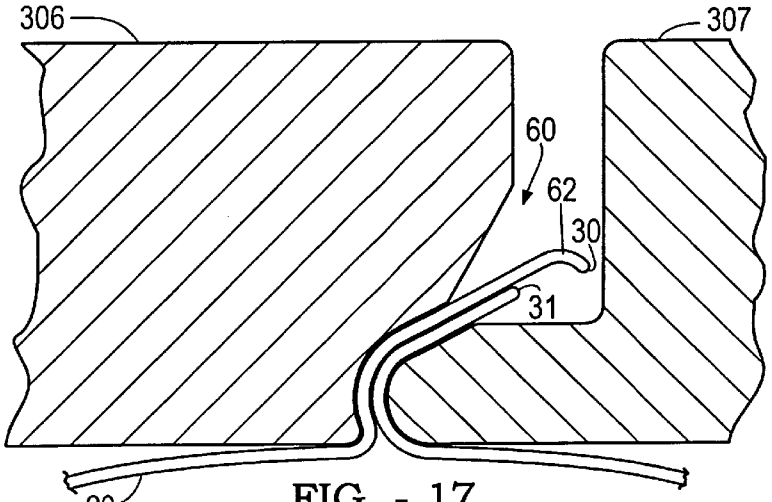
FIG. 17 is a partial cross-sectional view of an illustrative apparatus for forming a lock seam, according to the general teachings of the present invention, wherein the fourth major formation step is shown.

Referring to FIG. 17, there is shown a partial cross-sectional view of the illustrative apparatus during the fourth major formation step for forming a lock seam, according to the general teachings of the present invention. In this view, edge 30 is further contacted by roll 306 which presses toward the direction of roll 307. In this manner, both edges 30 and 31 of flange-like projection 60 are pushed even further downwardly.

Figure 18:
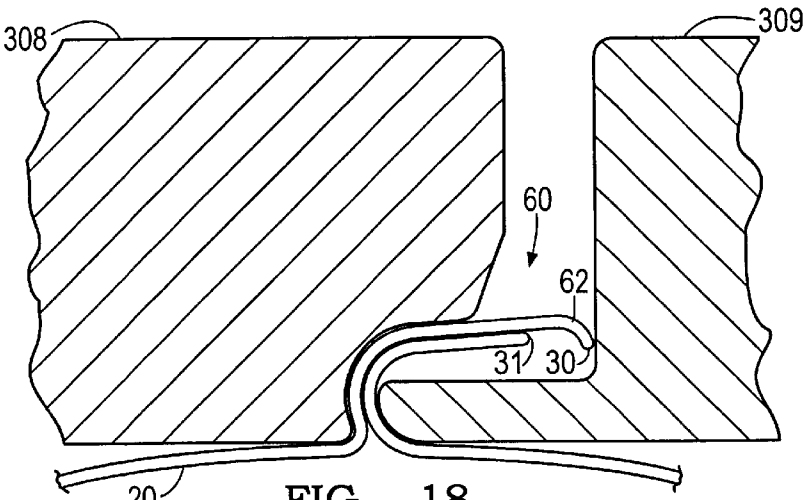
FIG. 18 is a partial cross-sectional view of an illustrative apparatus for forming a lock seam, according to the general teachings of the present invention, wherein the fifth major formation step is shown.

Referring to FIG. 18, there is shown a partial cross-sectional view of the illustrative apparatus during the fifth major formation step for forming a lock seam, according to the general teachings of the present invention. In this view, edge 30 is further contacted by roll 308 which presses toward the direction of roll 309. In this manner, both edges 30 and 31 of flange-like projection 60 are pushed still further downwardly so as to be almost parallel to the surface of outer wrap 20.

Figure 19:
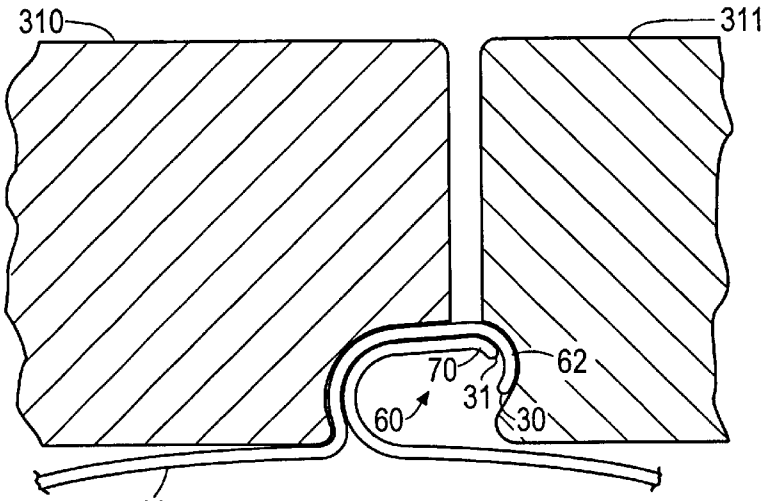
FIG. 19 is a partial cross-sectional view of an illustrative apparatus for forming a lock seam, according to the general teachings of the present invention, wherein the sixth major formation step is shown.

Referring to FIG. 19, there is shown a partial cross-sectional view of the illustrative apparatus during the sixth major formation step for forming a lock seam, according to the general teachings of the present invention. In this view, edge 30 is contacted by roll 311 which presses toward the direction of roll 310 which remains stationary. In this manner, curl 70 is formed on edge 31 and curl 62 is further formed on edge 30 of flange-like projection 60.

Figure 20:
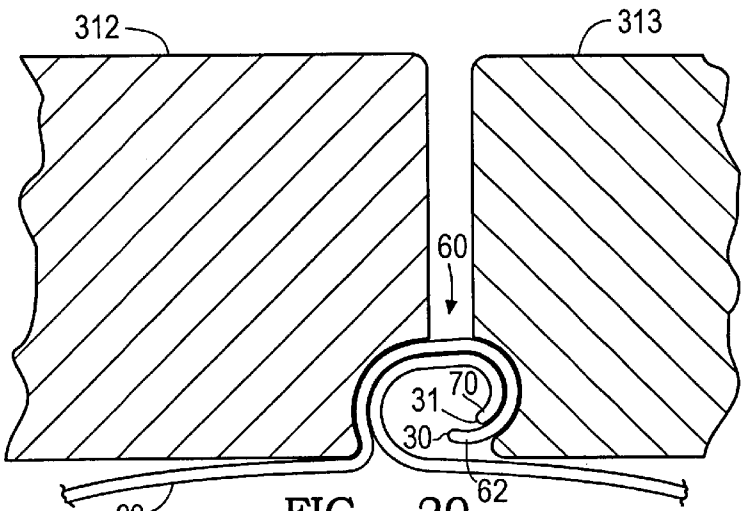
FIG. 20 is a partial cross-sectional view of an illustrative apparatus for forming a lock seam, according to the general teachings of the present invention, wherein the seventh major formation step is shown.

Referring to FIG. 20, there is shown a partial cross-sectional view of the illustrative apparatus during the seventh major formation step for forming a lock seam, according to the general teachings of the present invention. In this view, edge 30 is further contacted by roll 313 which presses toward the direction of roll 312. In this manner, curl 62 and 70 are both further formed on edge 30 and 31, respectively, of flange-like projection 60.

Figure 21:
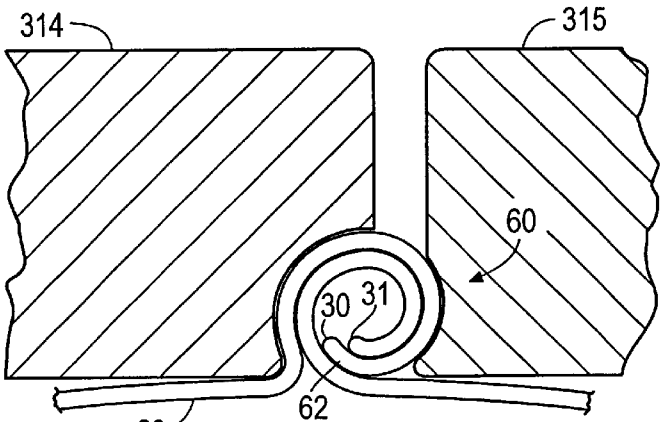
FIG. 21 is a partial cross-sectional view of an illustrative apparatus for forming a lock seam, according to the general teachings of the present invention, wherein the eighth major formation step is shown.

Referring to FIG. 21, there is shown a partial cross-sectional view of the illustrative apparatus during the eighth and final major formation step for forming a lock seam, according to the general teachings of the present invention. In this view, edge 30 is further contacted by roll 315 which presses toward the direction of roll 314. In this manner, curl 62 and 70 are both fully formed on edge 30 and 31, respectively, of flange-like projection 60. Edge 30 contacts the top surface of outer wrap 20 thus forming the lock seal of the present invention (as shown in greater detail in FIG. 4).

It should be noted that no gaps are formed as a result of the lock seam formation process of the present invention. Additionally, the application of forces parallel or at least substantially parallel to the object to be encapsulated does not typically result in damage to either the seam, the outer wrap, and/or the object to be encapsulated (e.g., the muffler canister).

The invention being thus described, it will be obvious that the same may be varied in many ways. Such variations are not to be regarded as a departure from the spirit and scope of the invention. Such variations or modifications, as would be obvious to one skilled in the art, are intended to be included within the scope of the following claims.

What is claimed is:

1. A method for forming a seam, comprising:

providing a sheet having spaced and opposed first and second edges;

providing an object to be encapsulated by the sheet;

positioning the object on the sheet parallel to the first and second edges;

manipulating the first and second edges towards one another so that the surfaces of the first and second edges contact one another in a substantially flush manner so as to form a flange-like projection, wherein one edge extends past the other edge;

manipulating the flange-like projection so as to form the seam, wherein the seam comprises the first edge wrapped in a first curl and the second edge wrapped in a second curl, the first curl being substantially circular in shape and the second curl being substantially circular in shape, wherein an inside surface of the first curl is wrapped about an outer surface of the second curl, wherein an inside surface of the second curl defines a substantially circular aperture which remains in the finish seam as formed.

2. The invention according to claim 1, wherein the sheet is an outer wrap for a muffler.

3. The invention according to claim 1, wherein the object is a muffler canister for a muffler.

4. The invention according to claim 1, wherein the seam is a pressureless seam.

5. The invention according to claim 1, wherein the seam is a mechanical seam.

6. The invention according to claim 1, wherein the manipulation of the flange-like projection includes the application of at least one force directed substantially parallel to the object.

7. A method for forming a seam for a muffler, comprising:

providing an outer wrap having spaced and opposed first and second edges;

providing a muffler canister to by encapsulated by the outer wrap;

positioning the muffler canister on the outer wrap parallel to the first and second edges;

manipulating the first and second edges towards one another so that the surfaces of the first and second edges contact one another in a substantially flush manner so as to form a flange-like projection, wherein one edge extends past the other edge;

manipulating the flange-like projection so as to form the seam, wherein the seam comprises the first edge wrapped in a first curl and the second edge wrapped in a second curl, the first curl being substantially circular in shape and the second curl being substantially circular in shape, wherein an inside surface of the first curl is wrapped about an outer surface of the second curl, wherein an inside surface of the second curl defines a substantially circular aperture which remains in the finish seam as formed.

8. The invention according to claim 7, wherein the seam is a pressureless seam.

9. The invention according to claim 7, wherein the seam is a mechanical seam.

10. The invention according to claim 7, wherein the manipulation of the flange-like projection includes the application of at least one force directed substantially parallel to the muffler canister.

* * * * *